United States Patent [19]

Michelson

[11] Patent Number: 4,908,892

[45] Date of Patent: Mar. 20, 1990

[54] SPINAL SURGERY CHEST BOLSTER

[76] Inventor: Gary K. Michelson, 438 Sherman Canal, Venice, Calif. 90291

[21] Appl. No.: 268,379

[22] Filed: Nov. 7, 1988

[51] Int. Cl.[4] ..... A61G 13/00

[52] U.S. Cl. ..... 5/431; 5/435; 269/328

[58] Field of Search ..... 5/431, 434–437, 5/461; 128/70, 845, 857, 869, 871; 269/328

[56] References Cited

U.S. PATENT DOCUMENTS

| | | | |
|---|---|---|---|
| 2,839,766 | 6/1958 | Hull | 5/436 |
| 3,009,172 | 11/1961 | Eidam | 5/436 |
| 3,140,497 | 7/1964 | Carswell | 5/435 |
| 4,398,707 | 8/1983 | Cloward | 269/328 |
| 4,559,930 | 12/1985 | Cobiski | 269/328 X |

FOREIGN PATENT DOCUMENTS

| | | | |
|---|---|---|---|
| 122855 | 11/1969 | Norway | 5/436 |

*Primary Examiner*—Michael F. Trettel
*Attorney, Agent, or Firm*—Lewis Anten

[57] ABSTRACT

A covered foam bolster is in the shape of a truncated pyramid specialized for use with a spinal surgery frame on an inclined table for supporting the chest, shoulders and arms of the patient only. The truncated pyramid has cutout portions for supporting the arms of the patient and provides increasing support to the chest of the patient as the weight of the patient is increased.

7 Claims, 3 Drawing Sheets

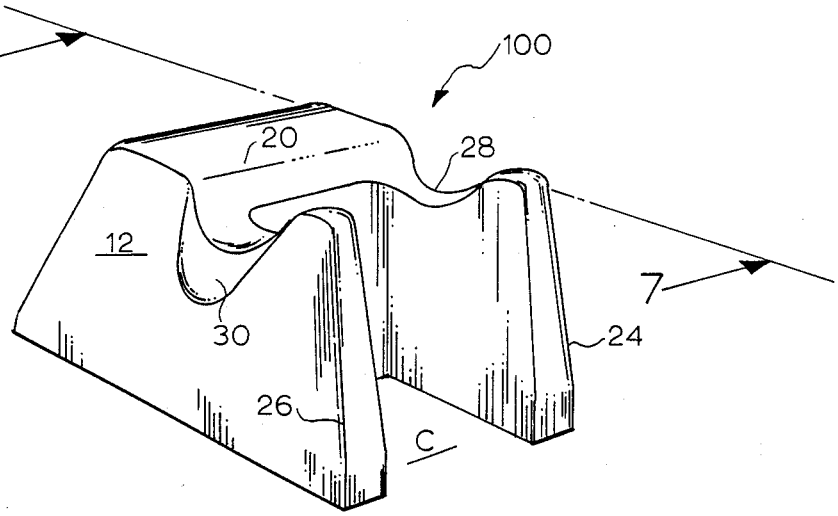
FIG. 1
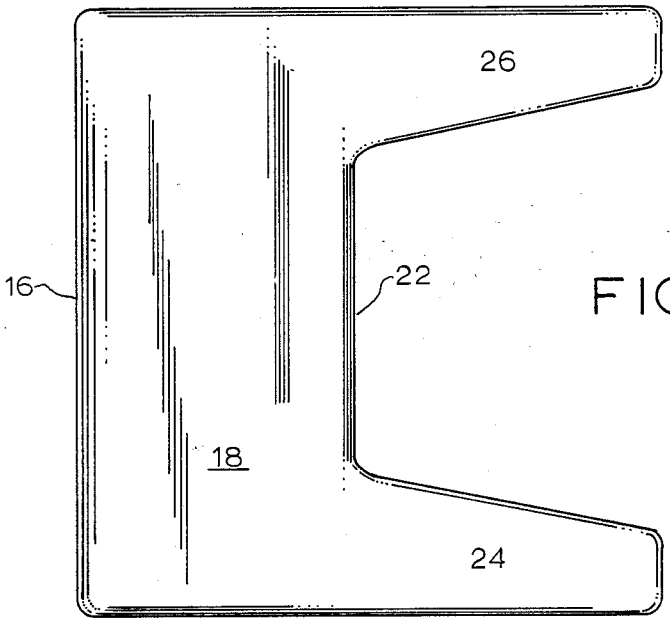
FIG. 5
FIG. 6
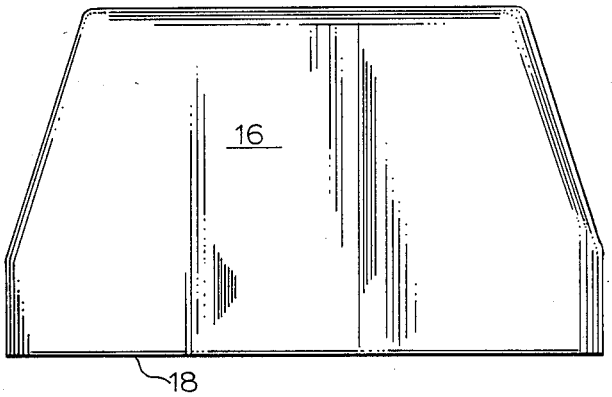

FIG. 7
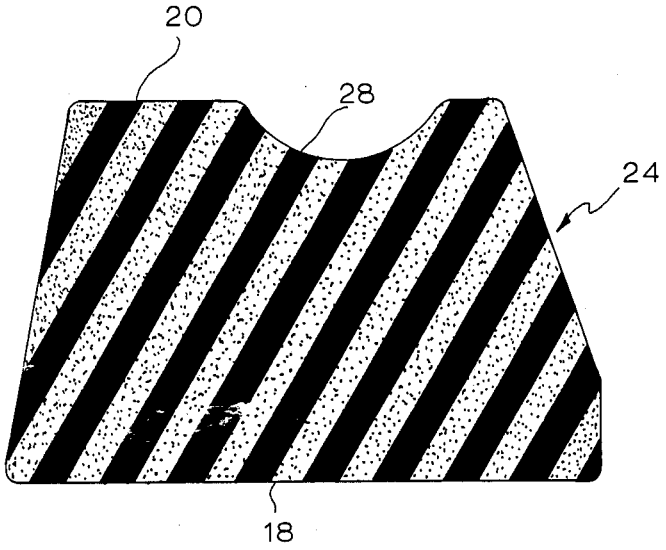
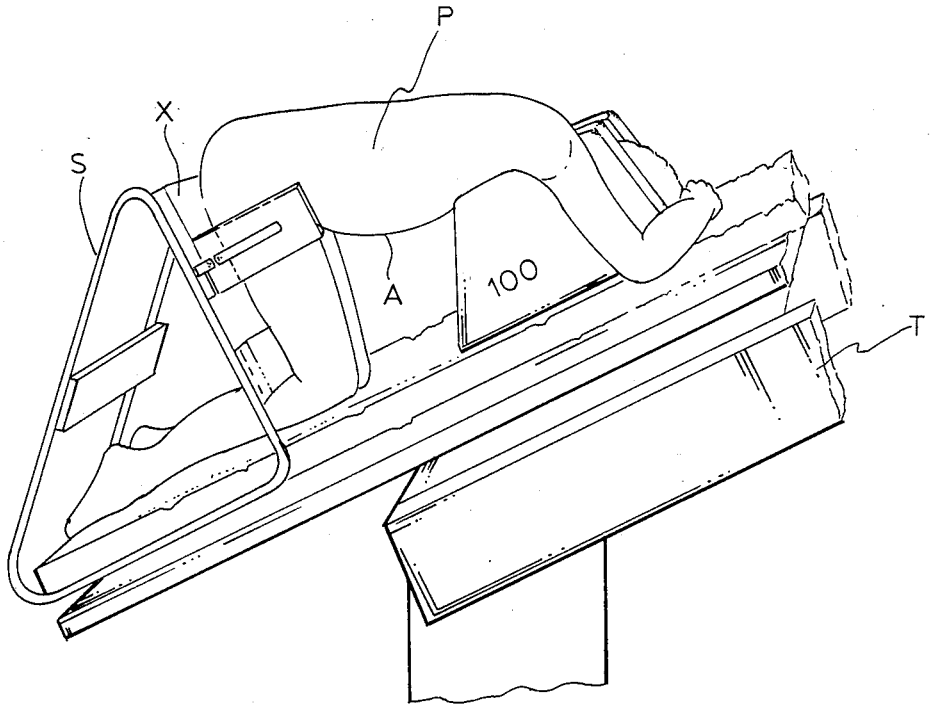
FIG. 8

SPINAL SURGERY CHEST BOLSTER

BACKGROUND

Posterior (from the back) spinal surgery requires that the patient be placed in the prone position. However, there are a great number of problems associated with just lying the patient flat out in the face down position.

Starting at the head end of the patient, the patient's neck will be either hyperextended, hyperrotated, or a combination thereof. The weight of the patient's head will come to rest on the periorbital region causing periorbital compression and edema and if continued for too long, eye damage. The weight of the torso lying over the chest increases the work of respiration and necessitates high ventilator drive pressures which cause the lung to transudate fluid (the pressure squeezes fluid from the lungs) and may lead to pulmonary edema. Furthermore, the pressure across the chest increases the pressure on the superior venae cava (the largest vein in the body which returns the blood to the heart) which results in a backup of pressure down the line and increased venous pressure in the spine, and therefore increased surgical bleeding. Similarly, and even more directly, pressure across the abdomen is directly transmitted via valveless connections to the spine and again results in increased bleeding at the spinal surgery site. Finally, the extended hip position produces a hyperlordosis (increased concavity) of the lumbar spine and shingling of the lamina producing an impediment to the surgery itself.

A significant improvement over the prone position can be obtained by the use of a spinal surgery frame as depicted in FIG. 8. The spinal surgery frame attaches to the operating room table and holds the patient in a modified half-seated, half-kneeling position.

A further improvement can be realized by the addition of a further support placed beneath the chest area of the patient which would allow the neck to fall into gentle flexion. Excessive neck flexion can be reduced by placing a soft pad beneath the patient's forehead which also is beneficial in that the face is then suspended, avoiding the problem of contact pressure to the eye area. Additionally, the use of the support beneath the chest returns the spine back into the horizontal position, facilitating surgery.

Unfortunately, there are also disadvantages associated with the use of conventional chest supports. First, there is the problem of pressure applied against the skin. Secondly, there is the problem of the pressure across the chest in general which increases the superior venae cava pressure and causes bleeding. Thirdly, when the chest is supported but the arms are not, then the large nerves passing from the chest area to the arm area, the brachial plexi, may be stretched, causing neurological injury.

At the present time, folded blankets or stacks of foam sheeting are generally used to support the chest. Also, larger rectangular foam blocks have been used by themselves. Also, a rectangular foam block attached to an ordinary automobile scissors jack has been used to elevate the pad. However, these are less than ideal.

SUMMARY OF THE PRESENT INVENTION

The present invention was specifically designed to be used in conjunction with The Spinal Surgery Frame of U.S. Pat. No. 4,481,943, but is compatible with almost all other frame designs where the use of a chest bolster is desirable. The above requires that the operating table be placed in a rather inclining position, thus necessitating the design of a chest bolster which would be restrained from migrating down the incline plane of the surgery table under the force of the superincumbent body weight. The present invention incorporates shoulder recesses with more cephalad (toward the head) shoulder engaging pillars. To avoid compression or tension on the brachial plexi (the large grouping of nerves passing thorough the axilla, or armpit area). The upper side walls are sloped gently outward to provide a natural angle for the arm from the body, and at the same time, gentle support.

To allow for the head and neck to fall into gentle flexion, the safest position for the spinal cord and cervical nerve roots, there is a large central cutout between the shoulder engagement pillars. This allows ample room for the head to be turned from side to side and also allows for the unobstructed exit of the endotracheal tube which is also easily visualized. Since the neck is in flexion, the head will come to rest on the forehead area, thus avoiding compression of the eyes, eye damage, and periorbital compression and edema.

As it is necessary for the chest support to accommodate patients of varying sizes and weights, the support has been deliberately designed to do so. The support itself is a truncated four-sided pyramid having a rectangular base. The contact area directly beneath the chest of the patient is rectangular. However, the bolster gets progressively larger in all planes from the top downward. Therefore, when a heavier patient is placed on the support, as compression of the bolster occurs an ever increasing infrastructure of foam is recruited to support the weight. To have simply used a stiffer foam and a uniform rectangular shape so as to support the heavier patient would have resulted in too hard a surface and possible skin damage to the lighter patient.

As with all padded goods to be used in the operating room, the foam is of acceptable medical quality and is totally encased in an impervious electro-conductive material in compliance with all operating room requirements.

OBJECTS OF THE PRESENT INVENTION

It is an object of the present invention to provide for a spinal surgery chest support that is safer;

It is another object of the present invention to provide for a spinal surgery chest support that is more comfortable;

It is still another object of the present invention to provide for a spinal surgery chest support that can accommodate a wide variety of patient sizes.

It is a yet another object of the present invention to provide for a spinal surgery support that is more economical.

These and other objects of the present invention will be apparent from a review of the following specification and the accompanying drawings.

BRIEF DESCRIPTION OF THE DRAWINGS

FIG. 1 is a top perspective view of the chest bolster of the present invention.

FIG. 5 is a bottom view of the chest bolster of the present invention.

FIG. 6 is a rear view of the chest bolster of the present invention.

FIG. 7 is a cross-sectional view of the chest bolster of the present invention taken along lines 7—7 of FIG. 1 of the present invention.

FIG. 8 is a perspective view of the chest bolster of the present invention illustrated as used on an operating table.

DETAILED DESCRIPTION OF THE PRESENT INVENTION

Figure 2:
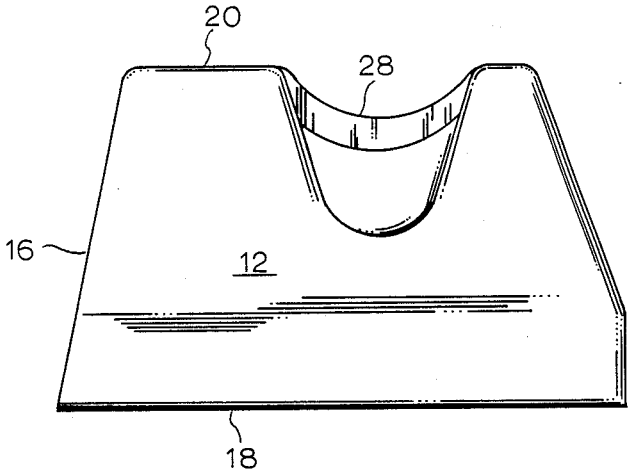
FIG. 2 is a right side view of the chest bolster of the present invention.
Figure 3:
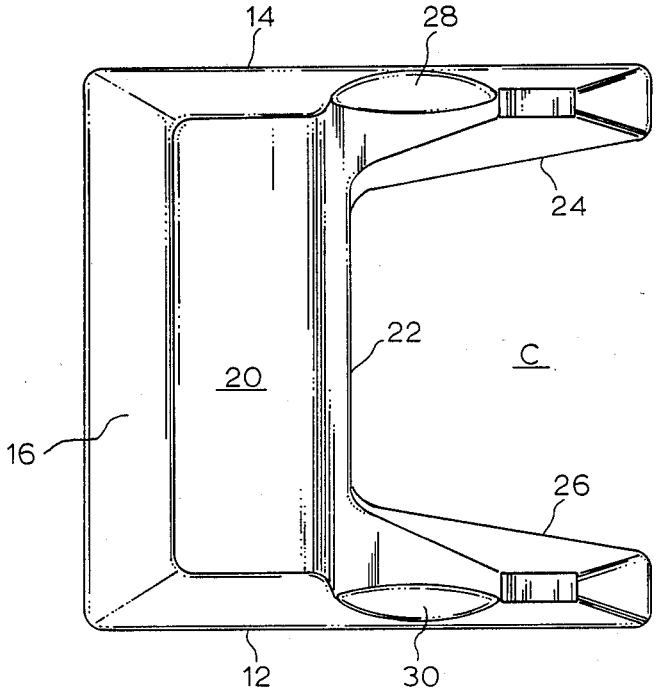
FIG. 3 is a top view of the chest bolster of the present invention.
Figure 4:
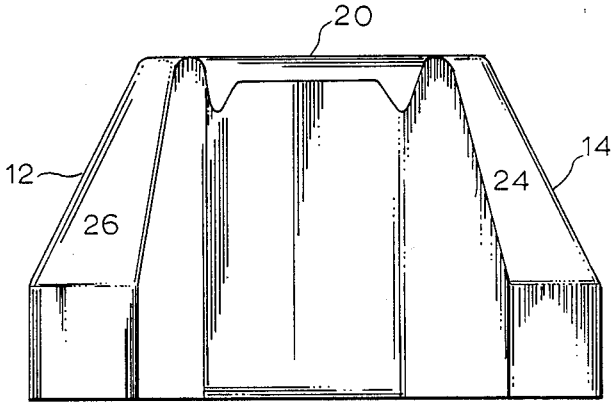
FIG. 4 is a front view of the chest bolster of the present invention.

Referring to the drawings, the spinal surgery chest support bolster 100 of the present invention is shown. The bolster 100 has the general shape of a four sided truncated pyramid, resting on a rectangular base, with a rectangular head cutout portion, passing from the top to bottom. The bolster 100 has side walls 12 and 14, rear wall 16, bottom surface 18 and top chest contact surface 20. A rectangular cut out portion C in the front wall, 22, passes from the top surface 20 to the bottom surface 18, forming two projecting arms 24 and 26, the height of the bolster 100. Shoulder arm cutouts 28 and 30, which have smooth tapered, contoured side walls and bottoms are located at the rear of the projecting arms 14 and 26, proximate the juncture of the side arm projections 24 and 26 and the top chest contact surface 20. The contouring of the side arm cut outs 28 and 30 are shown in FIGS. 1, 3 and 4. The head and neck cutout C, sloping rear wall 16, and the sloping front wall 22, all produce an overall truncated trapezoidal pyramid shape.

FIGS. 5 and 6 show the increased base of bottom 18 in relation to the chest support area 20. As the patient compresses the foam, the surface area of the contact surface 20 increases, providing additional support.

Referring to FIG. 7 the casing 50 and the inner foam 52 in shown. Any commercially available casing and medical grade foam may be used. In the preferred embodiment, the weight of the foam used is 1.78 pounds per cubic foot, it is classified as medium density, with a density rating of 30. A 10 inch round cylinder of foam with a 4 inch platform, would require 25 pounds of pressure to indent the foam 25 percent, which is comparable to one inch. The casing used is Lectrolite Duotone, it is an electroly conductive covering.

FIG. 8 is a perspective drawing of the bolster 100 of the present invention in use on operating table T with spinal surgery frame S. The patient P is shown face down with the patients rear end supported on the surgery frame, and the chest resting on the top chest contact surface 20 of the bolster 100. The head of the patient is shown within the head cutout C and the arms and shoulders resting on the arm cutouts 28 and 30. It can be seen that the bolster B anatomically supports the patient P and allows the abdomen A to hang free. It can also be seen that inclination of table T causes the patient P to sit on the cross frame and that by use of the bolster 100 the patient's back is again brought horizontal and the head and neck are in flexion where the arms are supported. In the preferred embodiment, the bolster 100 is 21 inches wide and 19 inches long at its base. The top surface 20 is approximately 14 inches long and approximately 6 inches wide. The height of the bolster is approximately 11 inches. The cutout C is approximately 13 inches by 10 inches, creating an arm cutout 28 and 30 having a width of about 4 inches and a length of 8 inches. The depth of the arm cutout 28 and 30, at the lowest part of the arcuate portion is approximately 2 inches about 6 inches along its top. The slope of the front wall 22 is approximately 10 degrees.

While the present invention has been disclosed with regards to the preferred embodiment, it is understood that variations for the present invention may be made without departing from the concept of the present invention. For example, other means besides foam may be used with the structure. Honeycomb, air filled or inflatable members and the like may all be used, in order to obtain the desired effect.

What is claimed is:

1. A bolster for supporting the chest of a patient, said bolster comprising a member having a top chest support surface and a bottom surface, an opening for the patient's head, said opening being sufficiently large to permit the entire head and hair of the patient to pass into and through said opening, and arm support means, said bolster having an increased cross-section from the top support surface to the bottom surface.

2. The chest bolster of claim 1 in which said chest bolster has the shape of a four sided, truncated pyramid, the top surface being wider than the patient's sternum so as to avoid any pressure on the sternum of the patient.

3. The chest bolster of claim 1 in which said arm support means comprises two spaced apart arm projections, said arm projections having contoured semi circular depressions on a top surface of said arm projections.

4. The chest bolster of claim 1 in which said bolster is made of foam.

5. The chest bolster of claim 1 in which said foam is approximately 1.78 pounds per cubic foot.

6. The chest bolster of claim 1 in which said foam has a density rating of 30.

7. A chest bolster, said bolster comprising a member having a top chest support surface and a bottom surface, an opening for the head, said opening sufficiently large to permit the entire head and hair to pass through said opening and arm support means, said bolster having an increased cross-section from the top support surface to the bottom surface in which said arm support means comprises two spaced apart arm projections, said arm projections having contoured semi circular depressions on a top surface of said arm projections.

* * * * *